US006358026B1

(12) United States Patent
Palmore

(10) Patent No.: US 6,358,026 B1
(45) Date of Patent: Mar. 19, 2002

(54) PISTON-CARRIED SUCTION VALVE IN A RECIPROCATING COMPRESSOR

(75) Inventor: Thomas Lee Palmore, Tyler, TX (US)

(73) Assignee: American Standard International Inc., New York, NY (US)

( * ) Notice: Subject to any disclaimer, the term of this patent is extended or adjusted under 35 U.S.C. 154(b) by 7 days.

(21) Appl. No.: 09/618,936

(22) Filed: Jul. 18, 2000

(51) Int. Cl.[7] ..... F04B 39/10
(52) U.S. Cl. ..... 417/545; 92/187; 123/193.6
(58) Field of Search ..... 417/415, 545, 417/552, 553; 93/187; 123/193.6

(56) References Cited

U.S. PATENT DOCUMENTS

| | | | | | |
|---|---|---|---|---|---|
| 2,895,421 | A | | 7/1959 | Peeps | 103/50 |
| 3,877,350 | A | * | 4/1975 | Earley et al. | 92/187 |
| 3,906,845 | A | | 9/1975 | Wegmann | 92/168 |
| 4,955,796 | A | | 9/1990 | Terwilliger | |
| 5,072,654 | A | * | 12/1991 | MacGregor | 92/157 |
| 5,080,130 | A | | 1/1992 | Terwilliger et al. | |
| 5,106,278 | A | | 4/1992 | Terwilliger | |
| 5,203,857 | A | | 4/1993 | Terwilliger et al. | |
| 5,476,371 | A | | 12/1995 | Dreiman | |
| 5,499,571 | A | | 3/1996 | Dreiman | |
| 5,584,676 | A | | 12/1996 | Dreiman | |
| 5,655,885 | A | | 8/1997 | Chung | 417/44.2 |
| 5,775,886 | A | * | 7/1998 | Terwilliger | 417/553 |
| 5,865,092 | A | * | 2/1999 | Woudwyk | 92/216 |
| 6,205,962 | B1 | * | 3/2001 | Berry, Jr. | 123/73 A |

FOREIGN PATENT DOCUMENTS

| | | |
|---|---|---|
| FR | 2566052 | 12/1985 |

* cited by examiner

*Primary Examiner*—Charles G. Freay
*Assistant Examiner*—William Rodriguez

(57) ABSTRACT

A reciprocating compressor carries suction valve apparatus on its piston in the form of a sheath. The sheath is retained and guided for motion both in conformance with and relative to the piston on which it is carried so as to accommodate both the flow of suction gas into the cylinder in which the piston-sheath combination is disposed and the compression of such gas therein. Retainers are disposed in the ends of the piston's wrist pin and have end faces disposed in accommodating apertures in the sheath. The configuration of the retainer end faces and the sheath apertures in which they are disposed act to limit and guide the movement of the sheath with respect to the piston.

28 Claims, 6 Drawing Sheets

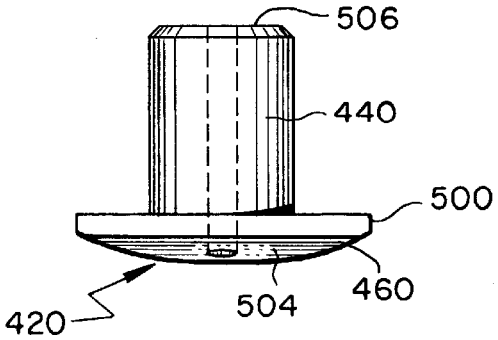
FIG. 9B
FIG. 9A
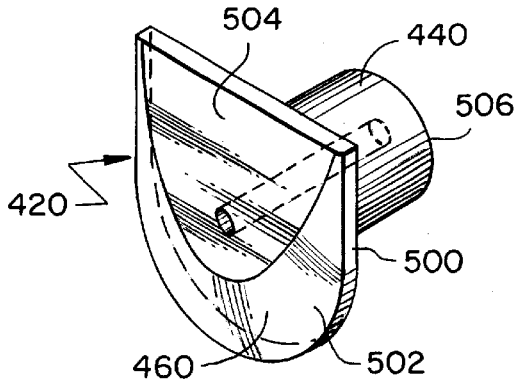
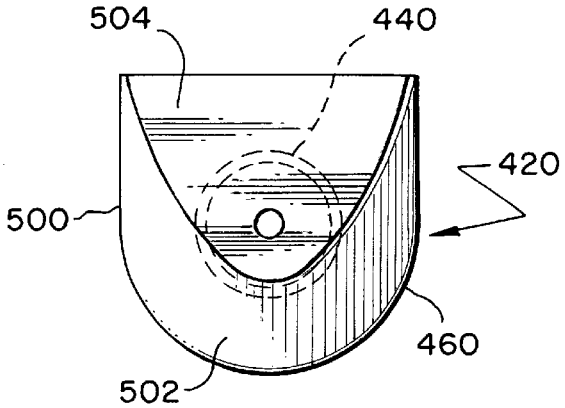
FIG. 9C
FIG. 10
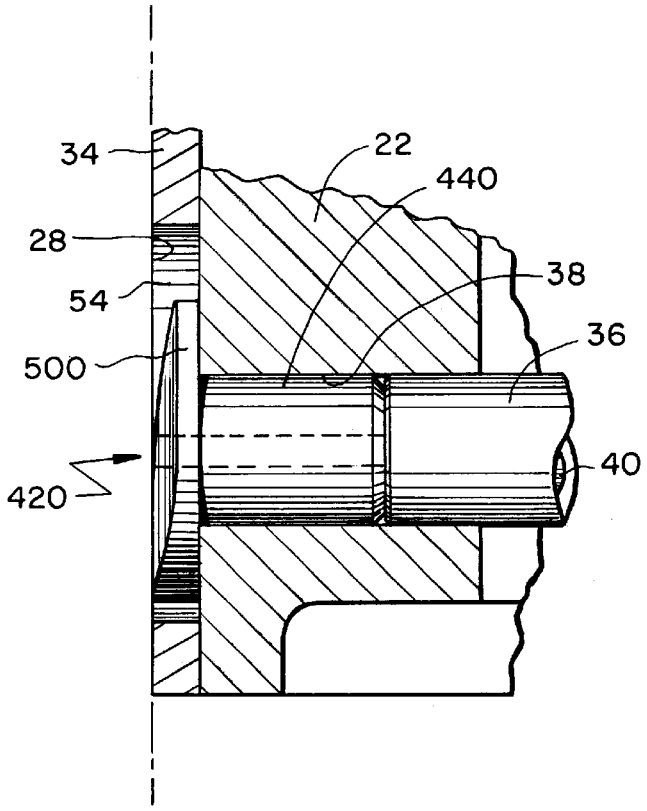

PISTON-CARRIED SUCTION VALVE IN A RECIPROCATING COMPRESSOR

BACKGROUND OF THE INVENTION

The present invention relates generally to reciprocating gas compressors. More particularly, the present invention relates to reciprocating compressors having piston-carried suction valves. With still more particularity, the present invention relates to an arrangement for guiding and retaining a suction valve on the piston of a reciprocating compressor.

Both efficiency and noise considerations are important in the design of reciprocating compressors. Efforts have been undertaken over the years to incorporate the suction valves of such compressors with or on a compressor's pistons so as to take advantage of the reciprocating movement of the piston to assist in the opening and/or closing of the valve. By use of the reciprocating action of a piston to assist in the opening and/or closing of a suction valve, efficiency advantages are prospectively obtainable. However, and as noted in U.S. Pat. 5,775,886 to G. Terwilliger which is incorporated herein by reference, obtaining both low noise and high efficiency in a reciprocating compressor is complicated by the fact that an improvement in one often degrades the other.

It is the object of the invention of the Terwilliger '886 patent to provide a novel gas compressor that improves the efficiency of a reciprocating compressor by the use of piston-carried suction valves and does so in a manner that addresses noise issues. In order to accomplish this goal, the '886 patent identifies a design for a piston-carried suction valve one component of which is a sheath that is positioned around the top of the piston on which it is carried. The underside of the top of the sheath is juxtaposed the top of the piston and the sides of the sheath are disposed between the piston and the walls of the cylinder in which the piston reciprocates. The sheath moves both with and relative to the piston in carrying out its suction valve function.

In that regard, during the suction stroke of the piston, an opening formed in the top of the sheath of the Terwilliger compressor allows low pressure gas to flow through a suction chamber, defined by the piston-sheath combination, into a compression chamber. The compression chamber is defined between the top of the sheath and the bottom surface of a discharge valve which overlies the cylinder. Overall, the flow of suction gas in the compressor is through suction gas passages formed in the compressor's cylinder block, through suction apertures defined in the sheath side wall that are in registry therewith, through the suction chamber defined by the piston-sheath combination, through the opening formed in the top of the sheath and into the compression chamber.

At the beginning of the compression stroke, the piston moves relative to and toward the sheath so as to force additional suction gas out of the suction chamber and into the compression chamber through the opening in the top of the sheath. The piston then continues its travel toward the discharge valve in concert with the sheath, a portion of the piston having moved into and closing the opening in the top of the sheath. The piston and sheath then act in cooperation and by their movement to compress the gas in the compression chamber.

Because the sheath and piston move both with and with respect to each other, provision must be made to guide and control the motion of the sheath with respect to the piston and to retain the sheath on the piston. In the case of the compressor of the Terwilliger '886 patent, a plurality of integrally formed, resilient fingers extend from the sheath to engage and retain the sheath on the piston. The length of the fingers controls and limits the relative movement of the sheath with respect to the piston.

The sheath of the '886 patent is, as noted therein, preferably fabricated from a thermoplastic material and the retaining fingers are therefore somewhat flexible. As such, the sheath and its fingers can be assembled to and over the top of a piston. If it becomes necessary, the resilient sheath fingers can be forced apart to allow for the separation and removal of the sheath from the piston.

Because the sheath fingers of the '886 patent are relatively expensive and difficult to mold/fabricate and under some conditions can be susceptible to breakage, the need exists for a guide/retainer arrangement for a sheath which functions as a suction valve in a reciprocating compressor that is robust, is relatively easy to mold/fabricate and which facilitates the assembly of the sheath to the piston on which it is carried.

SUMMARY OF THE PREFERRED INVENTION

It is an object of the present invention to provide a reciprocating compressor in which the compressor's suction valve apparatus is carried on and is actuated by the reciprocation of the compressor's pistons.

It is a further object of the present invention to provide for the retention of a sheath on a piston in a reciprocating compressor where the sheath acts as a suction valve and moves both with and relative to the piston on which lit is carried.

It is a still further object of the present invention to provide for the robust, simplified and enhanced retention and guidance of a piston-carried sheath which functions as a suction valve in a reciprocating compressor by the use of retainers which are disposed and move within accommodating apertures in the sheath and which are secured to the wrist pin through which the piston is driven.

These and other objects of the present invention, which will better be appreciated by reference to the Description of the Preferred Embodiment which follows and the Drawing Figures attached hereto, are achieved in a reciprocating compressor having a sheathed piston where the sheath operates as a suction valve and moves both with and relative to the piston. The relative movement of the sheath with respect to the piston is guided and limited by retainers disposed at the ends of the piston's wrist pin. The retainers have end faces which reside in accommodating apertures defined in the sidewall of the sheath member and both retain the sheath on the piston and limit the relative motion of the sheath with respect to the piston by the disposition of their end faces in the apertures defined in the sheath.

On the suction stroke, the piston and retainers move away from the discharge valve associated therewith and relative to the sheath until a first portion of the periphery of the end faces of the retainers make contact with an accommodating surface of the sheath apertures in which they are disposed. Once such contact is made, the sheath is pulled by and with the retainers so as to move in the same direction as the piston and a suction gas chamber is created between the top of the piston and the underside of the top of the sheath into which suction gas flows. Suction gas flows through suction gas apertures defined in the side of the sheath and into both the suction gas chamber defined between the piston and sheath and a compression chamber defined between the top of the sheath and the discharge valve associated with the cylinder in which the sheath/piston combination resides.

On the compression stroke, the piston and retainers move toward the discharge valve while the end faces of the retainers move within the sheath apertures in which they are disposed. The suction gas that has flowed into the suction volume defined between the piston and sheath during the suction stroke is forced thereoutof and into the compression chamber through an opening defined in the top of the sheath as a result of the initial relative motion of the piston and retainers with respect to the sheath. The movement of the piston toward the discharge valve progresses to a point where the piston comes into contact with the underside of the sheath and the opening defined in the top of the sheath comes to be closed by the contoured upper surface of the piston.

As a result of the contact of the piston with the sheath, the sheath is caused to move in direct concert with the piston toward the discharge valve. The cooperative movement of the piston and sheath toward the discharge valve and the closure of the opening in the top of the sheath causes the gas that exists in the compression chamber to be compressed. When the pressure in the compression chamber reaches a predetermined level, the discharge valve is forced open by such gas pressure and the compressed gas exits the cylinder therethrough.

Overall, by the disposition of appropriately configured retainers in accommodating apertures defined in the sidewall of the sheath, the sheath is retained on the piston and is caused to move relative thereto in a controlled manner by an arrangement that is relatively quiet, is robust, promotes compressor efficiency, is relatively simple and inexpensive, both with respect to its fabrication and assembly, and which eliminates certain of the disadvantages associated with prior sheath retention arrangements for reciprocating compressors in which suction valve apparatus is carried on the piston in the form of a sheath.

DESCRIPTION OF THE DRAWING FIGURES

FIGS. 9A, 9B and 9C are perspective, top and end views of an alternative embodiment of the retainer of the present invention.

FIG. 10 is a cross sectional view of the retainer of FIG. 9 as disposed in the compressor of the present invention.

DESCRIPTION OF THE PREFERRED EMBODIMENT

Figure 1:
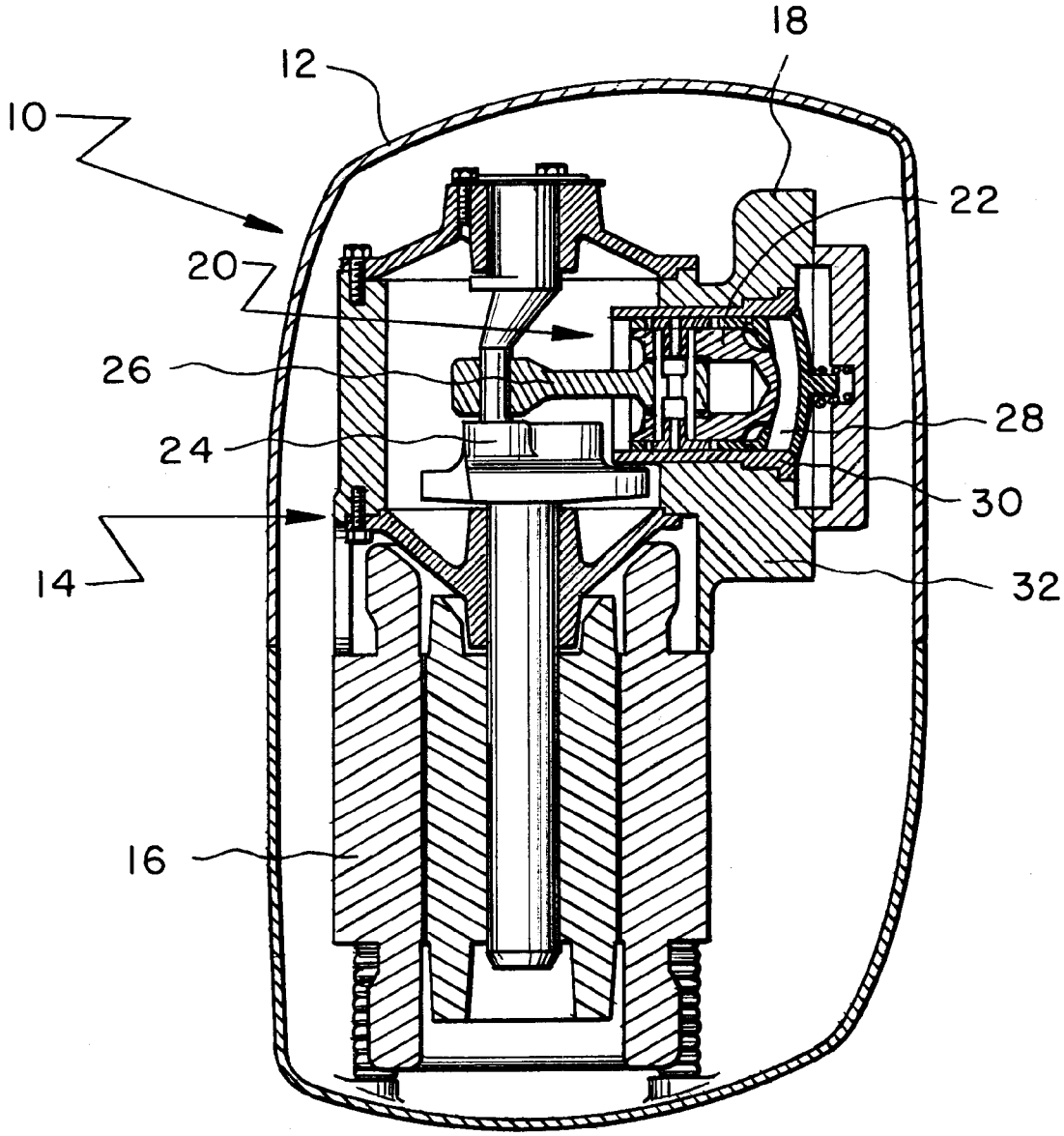
FIG. 1 is a cross-sectional view of the compressor of the present invention.

Referring initially to FIG. 1, compressor 10 includes a shell 12 in which a motor-compressor 14 is disposed. Motor-compressor 14 includes motor 16 and compression apparatus 18. Compression apparatus 18 includes one or more piston/cylinder combinations 20.

The piston-cylinder combinations in the compressor of the present invention include a piston 22 that is coupled to a crankshaft 24 by a connecting rod 26. The rotation of crankshaft 24, as driven by motor 16, causes piston 22 to reciprocate within cylinder 28. Cylinder 28 is integrally formed or may be formed by an insert, such as cylinder insert 30, disposed within cylinder block 32 of the compressor.

Figure 2:
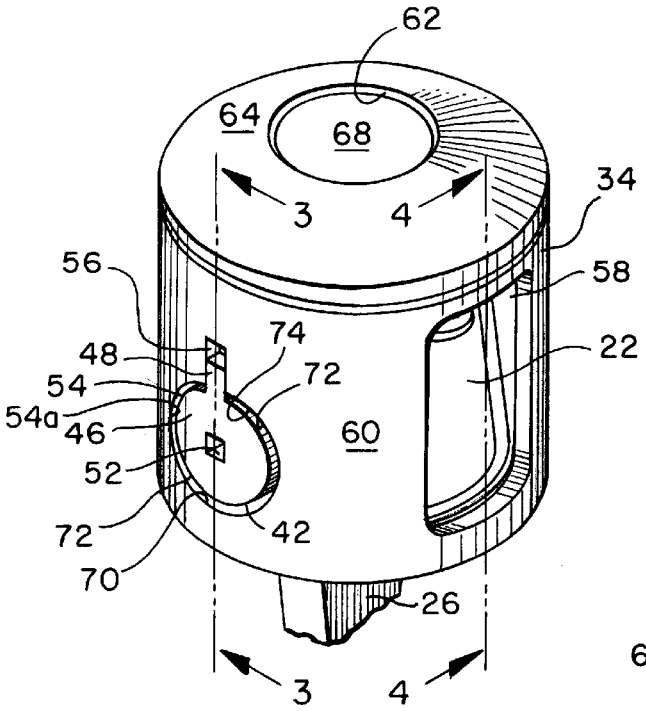
FIG. 2 is a perspective view of a sheathed piston of the compressor of the present invention.
Figure 3:
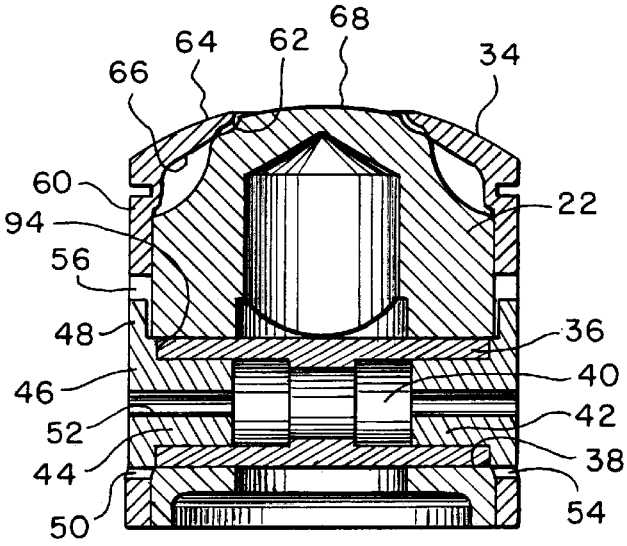
FIG. 3 is a cross-sectional view of the piston/sheath/sheath retention arrangement of the present invention taken along line 3—3 of FIG. 2.
Figure 4:
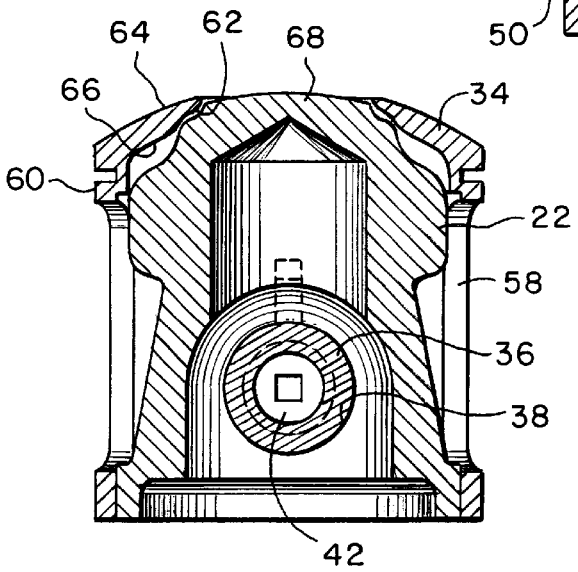
FIG. 4 is a cross-sectional view of the sheathed piston arrangement of the present invention taken along line 4—4 of FIG. 2 which is 90° apart from line 3—3.

Referring additionally now to Drawing FIGS. 2, 3 and 4, sheath 34 acts as the suction valve apparatus for the piston-cylinder combination 20 employed in compressor 10 and is preferably fabricated from a relatively lightweight thermoplastic material. Sheath 34 is disposed on piston 22 and is caused to reciprocate therewith within cylinder 28.

In that regard, the motion of connecting rod 26, which is pivotally connected to piston 22, is conveyed to piston 22 through a wrist pin 36. Wrist pin 36 is ensconced within wrist pin apertures 38 that are defined in the sidewall of piston 22. In the preferred embodiment, wrist pin 36 defines hollows 40 at both of its ends which accommodate the insertion of retainers 42 thereinto. Retainers 42 function as the apparatus by which sheath 34 is connected to piston 22 in a manner that will subsequently be described.

Figure 5:
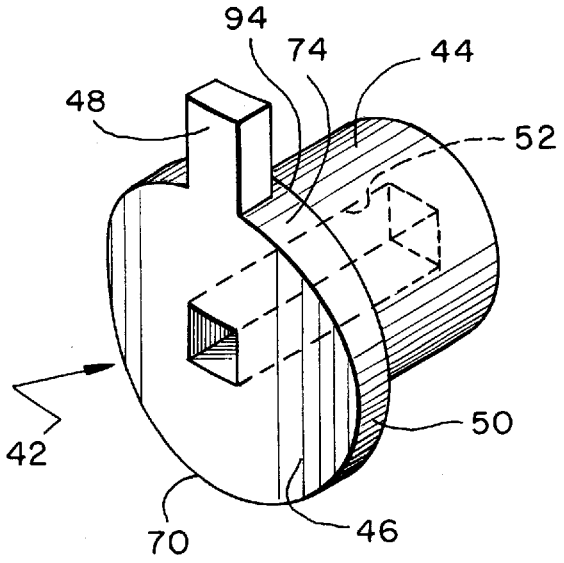
FIG. 5 is a perspective view of a first embodiment of the retainer of the present invention.
Figure 6:
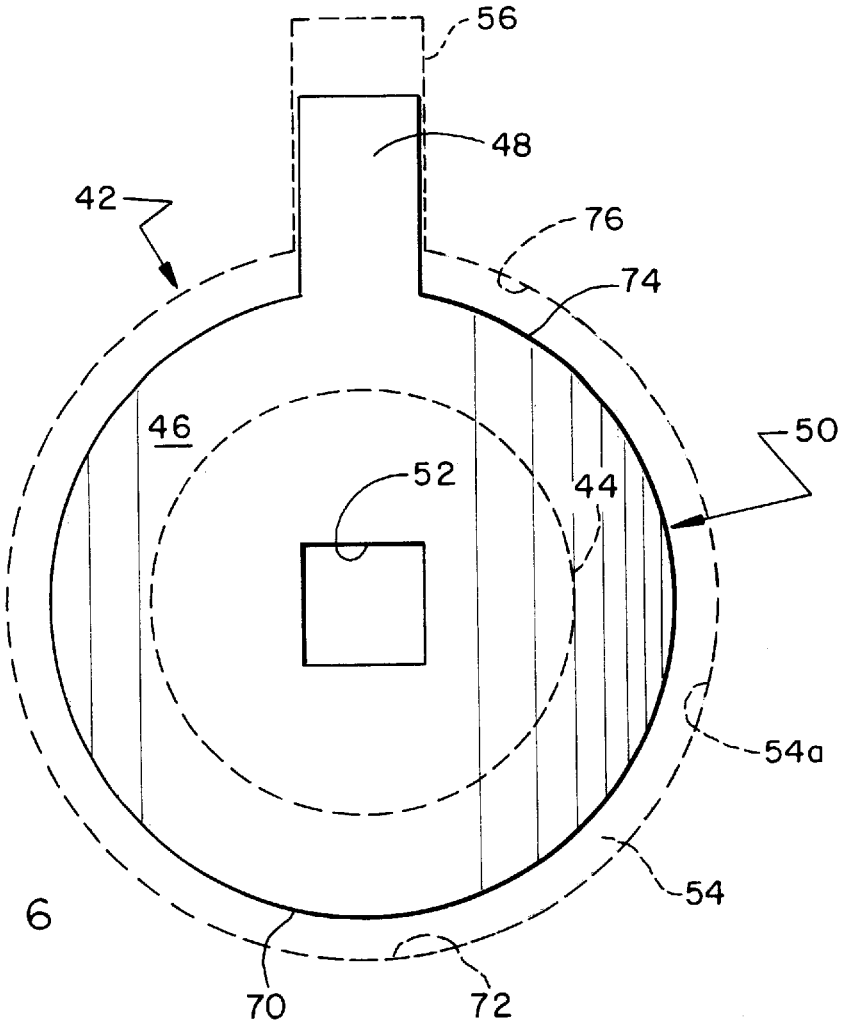
FIG. 6 is an end view of a first embodiment of the retainer of the present invention illustrating, in phantom, its relative positioning within the sheath aperture in which it is disposed.

Referring additionally now to FIGS. 5 and 6, retainers 42 each include a barrel portion 44 that terminates at a first end and an end face portion 46 disposed at the opposite end of the barrel portion. A guide 48 extends, in the preferred embodiment, from peripheral surface 50 of end face portion 46. Each of retainers 42 defines a passage 52 which runs axially through it and which can be used, with a tool, to align the retainers during their assembly to the wrist pin or to assist in their removal therefrom if necessary.

End face portions 46 of retainers 42 are accommodated in cooperatively configured retainer apertures 54 that are defined on opposite sides of sheath 34 by means of a generally curvilinear circumscribing surface 54*a* thereof. As is indicated in the drawing figures, retainer apertures 54, in the preferred embodiment, include slot portions 56 in which guides 48 of retainers 42 are slideably accommodated. Guides 48 reciprocate within guide slot portions 56 and maintain the orientation of the retainers with respect to the wrist pin, the sheath and the sheath apertures. Both guides 48 of retainers 42 and guide slot portions 56 of apertures 54 can be dispensed with although use of them is made in the preferred embodiment in order to prevent rotation of the retainers which ensures that there will be no binding between the retainers and the wall of cylinder 28.

Sheath 34, in addition to defining retainer apertures 54, defines suction gas apertures 58 generally on opposite sides of its side wall 60. Suction gas apertures 58 are disposed generally 90° around side wall 60 from retainer apertures 54.

Sheath 34 also defines an opening 62 in its top surface 64. As will be apparent from FIGS. 3 and 4, the upper portion of piston 22 has a protrusion 68 that extends from it and is contoured in a manner to facilitate its interaction and general conformance with the contoured undersurface 66 of top surface 64 of sheath 34. Protrusion 68 is configured to conformably fit into and close opening 62 of sheath 34 during the compression stroke of piston 22 as will further be described.

Figure 7:
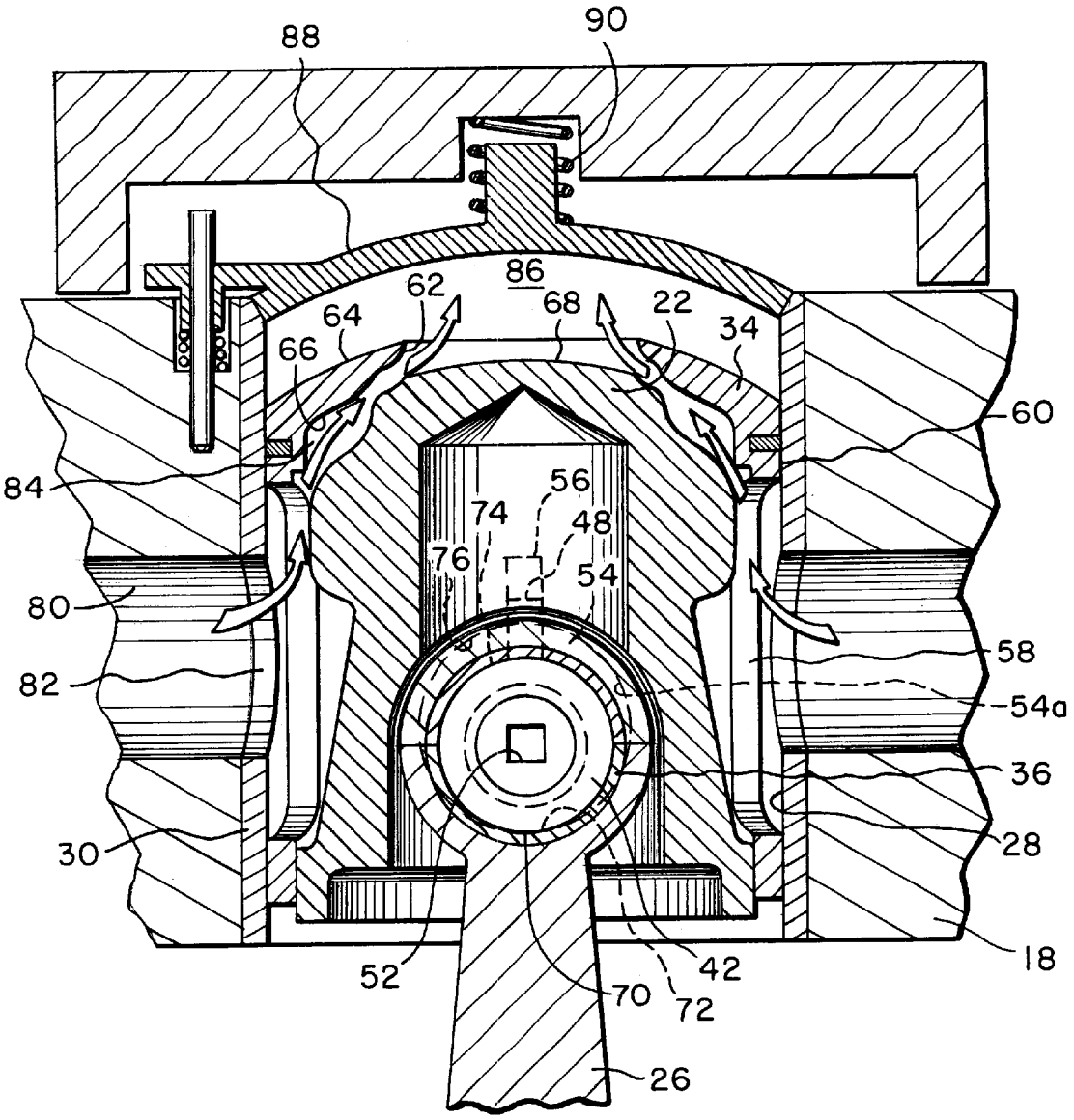
FIG. 7 is a cross-sectional view of the sheathed piston arrangement of FIG. 2 as disposed in the compressor of FIG. 1 showing the relative positions of the sheath, the piston, the suction apertures defined in the sheath and the retainer end faces at the bottom of the piston's suction stroke.
Figure 8:
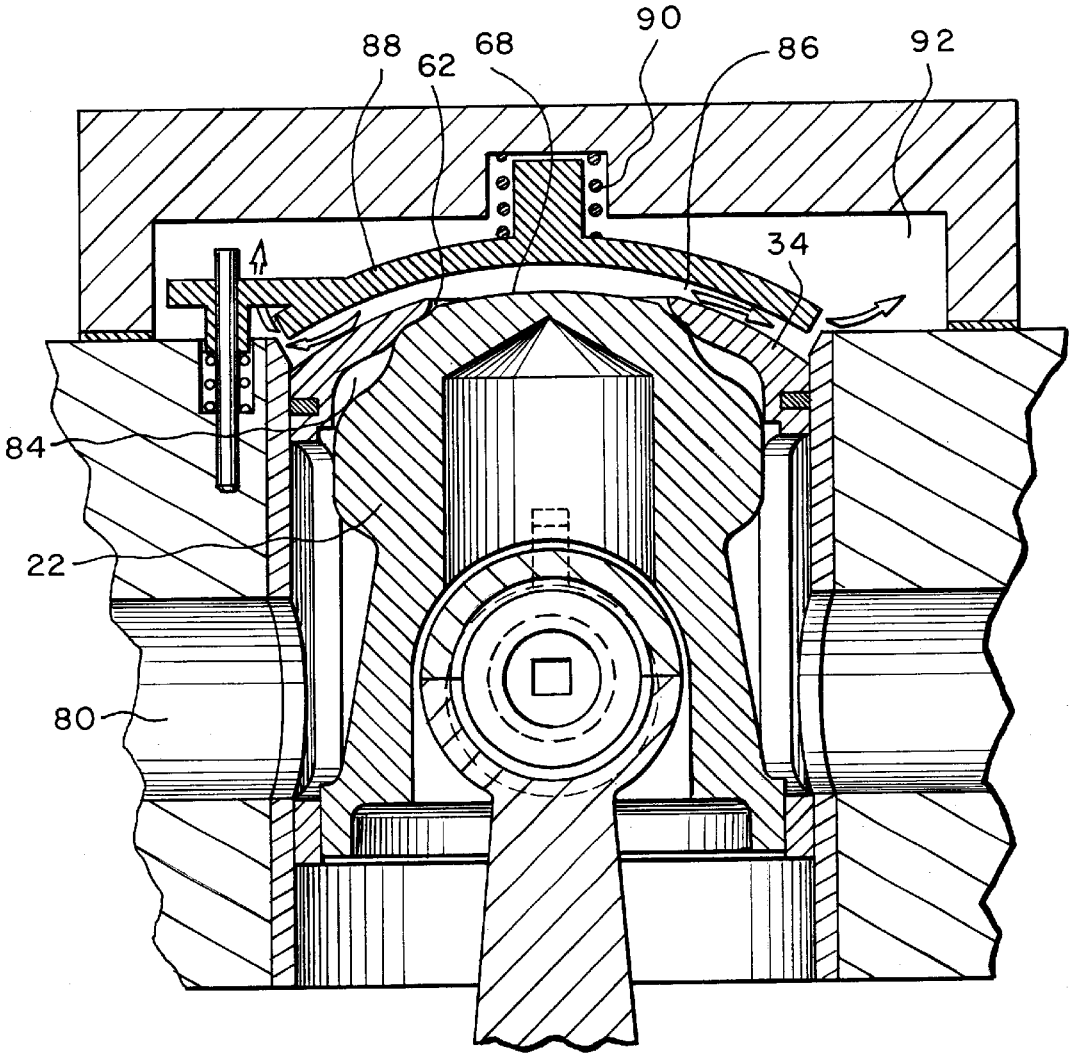
FIG. 8 is a cross-sectional view of the sheathed piston arrangement of FIG. 2 as disposed in the compressor of FIG. 1 showing the relative positions of the sheath, the piston, the suction apertures defined in the sheath and the retainer end faces at the top of the piston's compression stroke.

Referring primarily now to FIG. 6 and additionally to FIGS. 7 and 8, when piston 22 moves in a direction away from sheath 34 during the piston's suction stroke, the bottom surfaces 70 of peripheral surface 50 of retainers 42 move in conformance therewith and into contact with accommodating bottom surfaces 72 of retainer apertures 54 in sheath 34. When such contact is made, sheath 34 is caused to move cooperatively and in conformance with piston 22, ultimately to the bottom of the piston's suction stroke, where these components are positioned as illustrated in FIG. 7.

When piston 22 then moves in the opposite direction during the compressor's compression stoke, bottom surfaces 70 of peripheral 50 of retainers 42 move off of and away from bottom surfaces 72 of sheath apertures 54. However, shoulder surfaces 74 of peripheral 50 of retainers 42 preferably do not move into contact with accommodating shoulder surfaces 76 of the sheath aperture, stopping short thereof, because before such contact can occur, in the preferred embodiment, the upper portion of piston 22 will have come into contact with undersurface 66 of top surface 64 of sheath 34. Once contact is made by the upper portion of the piston with the undersurface of top surface 64 of sheath 34, sheath 34 is pushed upward by the movement of wrist pin 36, as transmitted through piston 22, and eventually makes its way, with the piston, to the top of its compression stroke where the components are positioned as illustrated in FIG. 8. As such, during a first portion of both of the suction and compression strokes, piston 22 and retainers 42 move relative to sheath 34 while during a second portion of both the compression and discharge strokes sheath 34 moves in conformance therewith.

Referring once again to FIG. 7, suction gas flows, during the suction stroke, through suction gas passages 80, that are defined in cylinder block 18, and then through communicating apertures 82 defined, in the preferred embodiment, in cylinder insert 30. As has been mentioned, the use of a cylinder insert that defines apertures through which suction gas flows is optional and in some compressor designs the insert will be dispensed with. The suction gas then enters cylinder 28, after passing through suction apertures 58 defined in sheath 34, and flows into suction chamber 84. Suction chamber 84 is cooperatively defined by the upper portion of piston 22 and the undersurface 66 of sheath 34 within cylinder 28.

Suction gas then flows through opening 62, defined in top surface 64 of sheath 34, into compression chamber 86 which is cooperatively defined within cylinder 28 between discharge valve 88, which is associated with cylinder 28, the upper surface 64 of sheath 34, protrusion 68 of piston 22 and the side wall of cylinder insert 30. During the suction stroke, sheath 34 is, once again, pulled away from discharge valve 88 by the contact of bottom surfaces 70 of retainers 42 with bottom surfaces 72 of sheath apertures 54 and suction gas flows into both suction chamber 84 and compression chamber 86 as a result of the then-existing pressure differential that will exist between the compression chamber and its source of suction gas, that being suction gas passages 80.

Referring additionally now to FIG. 8, during the compression stroke, suction gas passages 80 and suction chamber 84 become isolated from compression chamber 86 as a result of the closure of opening 62 in the top surface of the sheath which occurs as protrusion 68 moves thereinto. The piston-sheath combination, once opening 62 closes, continues its now cooperative travel toward discharge valve 88, compressing the gas trapped in the compression chamber in the process. As has been noted, sheath 34 is preferably fabricated from a thermoplastic material. As such, during the compression stroke, the buildup of pressure in the compression chamber and proximity of piston 22 to the undersurface of sheath 34 will cause a tight seal to be formed between the piston and sheath which does not allow the leakage of gas from the compression chamber back through sheath opening 62 to occur.

When the pressure in compression chamber 86 becomes sufficiently high, it overcomes the opposing force of spring 90 and causes the discharge valve to lift. Lifting of the discharge valve allows compressed gas to flow therepast and into a discharge chamber 92. From discharge chamber 92, the compressed gas travels out of the compressor to a location within the system in which compressor 10 is employed where use of it is made.

Referring now to FIGS. 9A, 9B, 9C and 10, an alternative embodiment 420 of retainer 42 of FIG. 5 is presented as is the disposition of such a retainer with respect to sheath 34, piston 22 and wrist pin 36. In the FIGS. 9 and 10 embodiment, piston 22 and sheath 34 are identical to those described with respect to FIGS. 2–8 as is wrist pin 36 although it is somewhat shortened in length. Like retainer 42, retainer 420 of the FIGS. 9 and 10 embodiment includes a barrel portion 440, an end face portion 460 and a peripheral surface 500. Rather than using a guide tab 48 to maintain the orientation of the retainer within retainer aperture 54 of sheath 34, the asymmetric shape of end face portion 460 accomplishes that purpose. In that regard, the upper portion of end face portion 460 in this embodiment is generally squared while the lower portion of end face portion 460 is curvilinear. Because the upper portion of end face portion 460 is squared, retainer 460 is prevented from rotation within the sheath aperture in which it resides and its orientation with respect to both piston 22 and sheath 34 is maintained.

It is also to be noted that end face portion 460 has a generally curvilinear surface 502 as well as a beveled planar surface 504. As such, the surface area of end face portion 460 which is immediately proximate the interior wall of cylinder 28 is reduced as compared to that of retainer 42 of the previous embodiment.

It is further to be noted that barrel portion 440 of wrist pin 420 is ensconced directly within wrist pin aperture 38 of piston 22, as opposed to being ensconced within hollow 40 of wrist pin 36 as was the case in the FIGS. 3 and 5 embodiment, and that end face 506 of wrist pin 460 faces and is juxtaposed the end surface of wrist pin 36. With respect thereto, it has been found that the diameteer of wrist pin aperture 38 is piston 22 will typically be more uniform and consistent that will be the diameter of hollows 40 of wrist pin 36 along their length. Therefore, by ensconcing the retainer within wrist pin aperture 38, the retainer is made less susceptible to jiggling and is kept more stable as it moves upward and downward within cylinder 28 with the reciprocation of piston 22 which reduces wear. As will be appreciated, it is contemplated that the retainer of the previous embodiment could likewise be ensconced within the wrist pin aperture as oposed to a hollow in wrist pin 36.

Finally, and referring back to the FIGS. 3 to 5 embodiment, it is to be noted that each of retainer 42 in that embodiment has a shoulder 94 that bears against an end of wrist pin 36 so as to appropriately position and face portions 46 of retainers 42 within the retainer apertures 54 defined by sheath 34. The overall thickness of end portions 46 of the retainer 42 at the location of shoulders 94 and the abutment thereof against the endos of wrist pin 36 both act to position end face portions 46 of the retainers within retainer apertures 54 of sheath 34 and to ensure that wrist pin 36 maintains its position in terms of its disposition with piston 22 and with respect to connecting rod 26 to which it is attached. With respect to the FIGS. 9 and 10 embodiment, shoulder 94 of the length of barrel portion 440 that determines and maintains wrist pin 36 in position with respect to the piston and connecting rod.

Overall, use of the retainers of the compressor of the present invention to guide and limit the relative motion of sheat 34 with respect to piston 22, results in the retention of sheath 34 is retained on piston 22 in a manner that is quiet, robust, relatively simple and inexpensive, both with respect to its fabrication and assembly. Further the arrangement is self-aligning, promotes compressor efficiency and eliminates certain of the disadvantages associated with earlier sheath retention arrangements for reciprocating compressors in which suction valve apparatus is carried on the piston in the form of a sheath.

While the present invention has been claimed in terms of a preferred embodiment, it will be appreciated that modifications thereto will be apparent to those skilled in the art and fall within its scope.

What is claimed is:

1. A reciprocating compressor comprising:

a shell;

a motor disposed in said shell; and compression apparatus, said compression apparatus being disposed in said shell and having a piston, a cylinder block, a suction valve and a suction valve retainer, said cylinder block defining a cylinder, said piston, said suction valve and said suction valve retainer all being disposed within said cylinder for reciprocation therein, said suction valve defining at least one retainer aperture, a first portion of said suction valve retainer being disposed in said retainer aperture, said retainer being connected to said piston so as to reciprocate in conformance therewith, said piston and said retainer moving relative to said suction valve during one portion of both of the suction and compression strokes of said piston within said cylinder and said suction valve moving in conformance with said retainer and said piston during a second portion of both of the suction and compression strokes of said piston.

2. The reciprocating compressor according to claim 1 further comprising a crankshaft and wherein said compression apparatus includes a connecting rod and a wrist pin, said crankshaft being driven by said motor and said crankshaft driving said piston through said connecting rod and through said wrist pin, said suction valve retainer moving in conformance with said wrist pin.

3. The reciprocating compressor according to claim 2 wherein said first portion of said suction valve retainer reciprocates within said aperture of said suction valve.

4. The reciprocating compressor according to claim 3 wherein said retainer aperture is defined by a circumscribing surface of said suction valve and wherein said first portion of said retainer has a peripheral surface, a first portion of said peripheral surface of said first portion of said retainer being in contact with a first portion of said circumscribing surface of said retainer aperture during the suction stroke of said piston.

5. The reciprocating compressor according to claim 4 wherein said wrist pin defines a hollow in at least one of its ends and wherein a second portion of said suction valve retainer is disposed in said hollow of said wrist pin.

6. The reciprocating compressor according to claim 5 wherein both said piston and said suction valve are generally cylindrical in nature and wherein said suction valve fits generally sheath-like over one end of said piston, said at least one retainer aperture being defined in a generally cylindrical side wall of said suction valve, said suction valve defining an opening in the surface thereof that is juxtaposed said one end of said piston, said one end of said piston moving into and closing said opening defined in the juxtaposed wall of said suction valve during the suction stroke of said piston and said end of said piston moving away from and opening said opening in said juxtaposed end of said piston during the suction stroke of said piston.

7. The reciprocating compressor according to claim 6 wherein said compressor includes at least two suction valve retainers, wherein said wrist pin defines a hollow at both of its ends and wherein said suction valve defines at least two retainer apertures, said retainer apertures being generally on opposite sides of said sheath, the second portions of each of said suction valve retainers being disposed in a hollow of said wrist pin and the first portions of each of said suction valve retainers being disposed in a retainer aperture defined by said suction valve.

8. The reciprocating compressor according to claim 7 wherein each of said at least two retainer apertures defined by said suction valve includes a slot portion and wherein said first portion of each of said retainers includes a guide, said guide extending from said peripheral surface of said first end portion of said retainers and being disposed for reciprocating movement in said slot portions of said at least two retainer apertures, said guides and said slots cooperating to maintain the orientation of said suction valve retainers with respect to said suction valve during the compression and discharge strokes of said piston.

9. The reciprocating compressor according to claim 7 wherein each of said at least two retainers defines a passage extending therethrough, said passage being generally parallel to the center line of said second distal end portion of said retainer and said passages being generally aligned with each other.

10. The reciprocating compressor according to claim 7 wherein said suction valve defines at least two suction gas openings in the cylindrical side wall thereof, said suction gas apertures being defined one each between said at least two retainer apertures.

11. The reciprocating compressor according to claim 7 wherein each of said at least two retainers has a shoulder, the shoulder of each of said retainers abutting an end of said wrist pin and thereby positioning said first end face portions of each of said retainers and the peripheral surfaces thereof within said at least two retainer apertures.

12. The reciprocating compressor according to claim 4 wherein said piston defines a wrist pin aperture, said wrist pin and a second portion of said suction valve retainer being disposed in said wrist pin aperture.

13. The reciprocating compressor according to claim 12 wherein both said piston and said suction valve are generally cylindrical in nature and wherein said suction valve fits generally sheath-like over one end of said piston, said at least one retainer aperture being defined in a generally cylindrical side wall of said suction valve, said suction valve defining an opening in the surface thereof that is juxtaposed said one end of said piston, said one end of said piston moving into and closing said opening defined in the juxtaposed wall of said suction valve during the suction stroke of said piston and said end of said piston moving away from and opening said opening in said juxtaposed end of said piston during the suction stroke of said piston.

14. The reciprocating compressor according to claim 13 wherein said compressor includes at least two suction valve retainers, wherein said suction valve defines at least two retainer apertures, said retainer apertures being generally on opposite sides of said sheath, the second portions of each of said suction valve retainers being disposed in said wrist pin aperture of said piston and the first portions of each of said suction valve retainers being disposed in a retainer aperture defined by said suction valve.

15. The reciprocating compressor according to claim 14 wherein the second portions of each of said suction valve retainers have a surface that is juxtaposed and faces an end of said wrist pin within said wrist pin aperture.

16. The reciprocating compressor according to claim 14 wherein said first portions of each of said retainers include a curvilinear surface, the curve of said curvilinear surface being consistent with the curve of the wall of said cylinder, said first portions also including a planar surface, said planar surface connecting to said curvilinear surface and depending away from said cylinder wall.

17. The reciprocating compressor according to claim 14 wherein the shape of said retainer apertures and the shape of said first portions of said retainers cooperate to prevent the rotation of said retainers within said retainer apertures as both said suction valve and said retainers reciprocate within said cylinder.

18. A suction valve arrangement for a reciprocating compressor comprising:

a piston;

a connecting rod;

a wrist pin, said wrist pin connecting said piston to said connecting rod;

a retainer, said retainer having an end face portion and being connected to said wrist pin so as to reciprocate in direct conformance therewith; and a suction valve, said suction valve having a surface which defines a retainer aperture and fitting sheath-like over an end of said piston, said end face portion of said retainer being disposed in said retainer aperture, a first surface of said end face portion of said retainer being positionable to contact a first portion of said surface which defines said retainer aperture of said suction valve so as to cause suction valve movement in a first direction.

19. The suction valve arrangement of claim 18 wherein said retainer has a barrel portion, said barrel portion extending from said end face portion of said retainer, said end face portion of said retainer being disposed in said retainer aperture and said barrel portion of said retainer being connected to said wrist pin for movement therewith.

20. The suction valve arrangement of claim 19 wherein said wrist pin is generally cylindrical and defines a hollow at least one of its ends, the terminal end of said barrel portion of said retainer being disposed in said hollow.

21. The suction valve arrangement according to claim 20 wherein said end portion of said retainer has a circumscribing surface, said first surface of said end face portion of said retainer being a portion of said circumscribing surface.

22. The suction valve arrangement according to claim 21 wherein said suction valve has a side wall and a top surface, said suction valve defining at least two retainer apertures and at least two suction gas openings as well as an opening in said top surface, said suction gas openings being generally opposite each other in said side wall of said suction valve and said retainer apertures being generally opposite each other in said side wall of said suction valve and being disposed, one each, between said retainer apertures, contact of said piston with said top surface of said suction valve causing said suction valve to move in a direction opposite said first direction.

23. The suction valve arrangement according to claim 22 said retainer apertures include a slot-like portion and wherein each of said retainers has a guide extending from said circumscribing surface, said guides being disposed for reciprocating motion within said slots and maintaining the orientation of said retainer with respect to said suction valve.

24. The suction valve arrangement according to claim 23 wherein said retainer has a shoulder portion, said shoulder portion abutting an end face of said wrist pin so as to position said circumscribing surface of said retainer within said retainer aperture.

25. The suction valve arrangement according to claim 18 wherein said wrist pin has an end surface and wherein said retainer has a barrel portion, said barrel portion extending from said end face portion of said retainer, said end face portion of said retainer being disposed in said retainer aperture and said barrel portion of said retainer having a surface that faces and is juxtaposed said end surface of said wrist pin.

26. The suction valve arrangement according to claim 25 wherein the shape of said retainer aperture of said suction valve and the shape of said end face portion of said retainer cooperate to prevent the rotation of said retainer.

27. The suction valve arrangement according to claim 26 wherein said end face portion of said retainer has a curvilinear surface and a planar surface, said curvilinear surface depending away from said curvilinear surface in the direction of said barrel portion of said retainer.

28. The suction valve arrangement according to claim 27 wherein said barrel portion of said retainer and said wrist pin are generally cylindrical in nature and have essentially the same outside diameter.

* * * * *

UNITED STATES PATENT AND TRADEMARK OFFICE

CERTIFICATE OF CORRECTION

PATENT NO. : 6,358,026 B1
DATED : March 19, 2002
INVENTOR(S) : Thomas Lee Palmore It is certified that error appears in the above-identified patent and that said Letters Patent is hereby corrected as shown below:

Column 7,
Line 4, after the word "of" insert -- Figure 3 and 5 embodiment is dispensed with and it is the --.

Signed and Sealed this

Second Day of July, 2002

*Attest:*

*Attesting Officer*

JAMES E. ROGAN
*Director of the United States Patent and Trademark Office*